US007814886B2

(12) United States Patent
Ranaldo et al.

(10) Patent No.: US 7,814,886 B2
(45) Date of Patent: Oct. 19, 2010

(54) SHUT-OFF VALVE FOR CONTROLLING THE FLOW RATE OF A FUEL PUMP FOR AN INTERNAL COMBUSTION ENGINE

(75) Inventors: Sandra Ranaldo, Bologna (IT); Pasquale Dragone, Matera (IT); Andrea Cobianchi, Bologna (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 694 days.

(21) Appl. No.: 11/897,815

(22) Filed: Aug. 30, 2007

(65) Prior Publication Data

US 2008/0054213 A1 Mar. 6, 2008

(30) Foreign Application Priority Data

Sep. 4, 2006 (EP) ..... 06425612

(51) Int. Cl.
*F02M 37/00* (2006.01)

(52) U.S. Cl. ..... 123/456; 123/458; 123/511

(58) Field of Classification Search ..... 123/446, 123/447, 456, 457, 458, 511
See application file for complete search history.

(56) References Cited

U.S. PATENT DOCUMENTS 6,006,728 A 12/1999 Matsuda et al.
6,131,880 A 10/2000 Hahn et al.
6,253,734 B1 * 7/2001 Rembold et al. ..... 123/446
2008/0245904 A1 * 10/2008 Harcombe et al. ..... 239/569
2009/0229573 A1 * 9/2009 Petrone et al. ..... 123/456

FOREIGN PATENT DOCUMENTS

DE 10 2004 052818 A1 5/2006
EP 0683315 A1 11/1995
EP 1088986 A1 4/2001
EP 1088987 A1 4/2001
EP 1429019 A1 6/2004

* cited by examiner

*Primary Examiner*—Hai H Huynh
(74) *Attorney, Agent, or Firm*—Mitchell P. Brook; Luce, Forward, Hamilton & Scripps LLP

(57) ABSTRACT

A shut-off valve of the flow rate of a fuel pump for an internal combustion engine; the shut-off valve is provided with: a tubular cylindrical body, which is closed on top, displays a cylindrical seat, the lower portion of which performs the function of fuel pipe, and comprises a number of radial through holes to allow the introduction of fuel within the cylindrical seat; a lower plate, which is arranged within the tubular cylindrical body and underneath the radial holes and has a central through hole which defines an outlet opening of the fuel; and a cylindrical shutter, which is coupled to the lower plate and is mobile between an open position, in which the outlet opening is in communication with the radial holes, and a closed position, in which the outlet opening is isolated from the radial holes.

20 Claims, 3 Drawing Sheets

SHUT-OFF VALVE FOR CONTROLLING THE FLOW RATE OF A FUEL PUMP FOR AN INTERNAL COMBUSTION ENGINE

TECHNICAL FIELD

The present invention relates to a shut-off valve for controlling the flow rate of a fuel pump for an internal combustion engine.

BACKGROUND ART

In a modern internal combustion engine of the common-rail type, a high-pressure pump receives a flow of fuel from a tank by means of a low-pressure pump and feeds the fuel to a common rail hydraulically connected to a plurality of injectors. The pressure of the fuel in the common rail must be constantly controlled according to the engine point either by varying the instantaneous flow rate of the high-pressure pump or by always feeding an excess of fuel to the common rail and by discharging the fuel in excess from the common rail itself by means of a regulation valve. Generally, the solution to vary the instantaneous flow rate of the high-pressure pump is preferred, because it displays a much higher energy efficiency and does not cause overheating of the fuel.

In order to vary the instantaneous flow rate of the high-pressure pump a solution of the type presented in patent application EP0481964A1 or in patent U.S. Pat. No. 6,116,870A1 has been suggested, which describes the use of a variable flow rate, high-pressure pump capable of feeding to the common rail only the amount of fuel needed to maintain the same fuel pressure as the required value within the common rail; specifically, the high-pressure pump is provided with an electromagnetic actuator capable of varying the flow rate of the high-pressure pump instant-by-instant by varying the closing time of an intake valve of the high-pressure pump itself.

Alternatively, to vary the instantaneous flow rate of the high-pressure pump, it has been suggested to insert a flow regulating device upstream of the pumping chamber, comprising a continuously variable section choke, which is controlled according to the pressure required within the common rail.

However, both solutions described above to vary the instantaneous flow rate of the high-pressure pump result mechanically complex and do not allow to regulate the instantaneous flow rate of the high-pressure pump with a high accuracy. Furthermore, the flow rate regulation device comprising a variable section choke displays a small passage section for low flow rates and such small passage section determines a high local pressure loss (local load loss) which may impair the correct operation of an intake valve which regulates the intake of fuel into a pumping chamber of the high-pressure pump.

For this reason, a solution of the type presented in patent application EP1612402A1 has been suggested, which relates to a high-pressure pump comprising a number of pumping elements actuated in reciprocal motion by means of corresponding intake and delivery strokes and wherein each pumping element is provided with a corresponding intake valve in communication with an intake pipe fed by a low-pressure pump; arranged on the intake pipe is a shut-off valve controlled in a choppered manner in synchronism with an initial part of the intake step of each pumping element. In other words, the shut-off valve is a valve of the open/closed (on/off) type which is driven by modifying the relation between the opening intervals and the closing intervals for varying the instantaneous flow rate of the high-pressure pump. In this way, the shut-off valve always displays an efficaciously wide passage section which does not determine an considerable local pressure loss (local load loss).

However, the shut-off valves known until now have a very unfavourable performance/cost ratio and accordingly imply an unjustified cost increase of the high-pressure pump.

DE102004052818A1 discloses a fuel injection system for an internal combustion engine and having an electromagnet for operating the control valve.

DISCLOSURE OF INVENTION

It is the object of the present invention to provide a shut-off valve for controlling the flow rate of a fuel pump for an internal combustion engine, such a shut-off valve being free from the drawbacks described above and specifically being easy and cost-effective to implement.

According to the present invention, there is provided a shut-off valve for controlling the flow rate of a fuel pump for an internal combustion engine as claimed in the attached claims.

BRIEF DESCRIPTION OF THE DRAWINGS

The present invention will now be described with reference to the accompanying drawings illustrating a non-limitative example of embodiment thereof, in which.

PREFERRED EMBODIMENTS OF THE INVENTION

Figure 1:
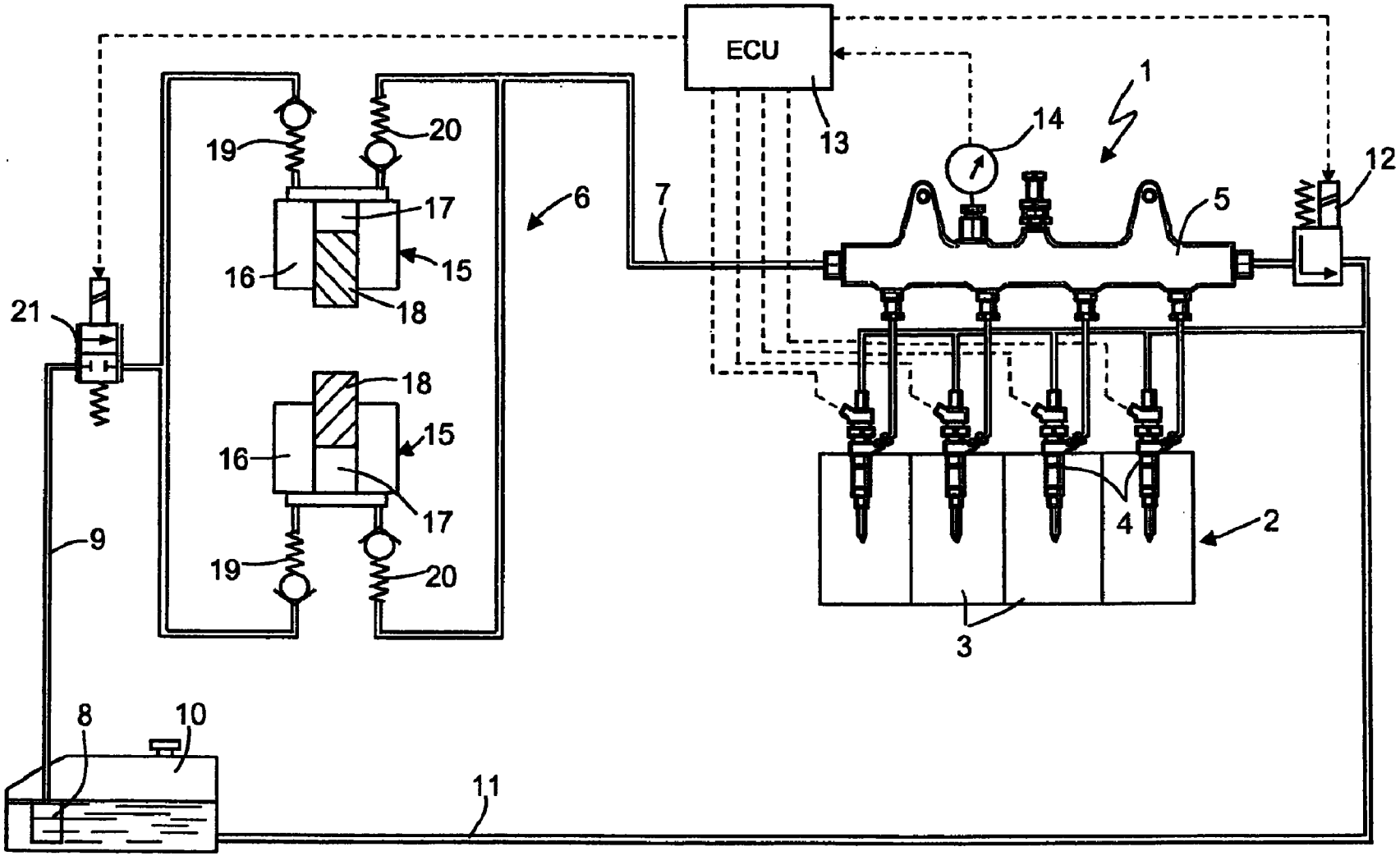
FIG. 1 is a schematic view of a fuel injection system for an internal combustion engine provided with a shut-off valve for controlling the flow rate obtained in accordance with the present invention.

In FIG. 1, numeral 1 indicates as a whole a fuel injection system for an internal combustion engine 2 provided with four cylinders 3. Injection system 1 comprises four injectors 4, each of which is coupled to a cylinder 3 for injecting the high-pressure fuel within the top of the cylinder 3 itself.

Injectors 4 receive the fuel from a common rail 5, which is fed with high-pressure fuel by a high-pressure pump 6 by means of a delivery pipe 7. In turn, high-pressure pump 6 is fed by a low-pressure pump 8 by means of an intake pipe 9 of high-pressure pump 6. Low-pressure pump 8 is arranged within a fuel tank 10, to which a recirculation pipe 11 of the fuel in excess in injection system 1 regulated by a discharge solenoid valve 12 leads.

Each injector 4 is adapted to inject in the corresponding cylinder 3 a variable quantity of fuel under the control of an electronic control unit 13, which is connected to a pressure sensor 14 which detects the fuel pressure within the common rail 5 and also controls discharge solenoid valve 12 in order to discharge possible fuel in excess existing in common rail 5 towards tank 10.

High-pressure pump 6 comprises a pair of pumping elements 15, each formed by a cylinder 16 having a pumping chamber 17, in which a piston 18 that is mobile in reciprocal motion slides under the bias of a cam (not shown) actuated by a crankshaft (not shown). Each compression chamber 17 is provided with a corresponding intake valve 19 in communication with intake pipe 9 and a corresponding delivery valve 20 in communication with delivery conduit 7.

Along intake pipe 9 is arranged a shut-off valve 21, which is controlled by electronic control unit 13 and is of the open/closed (on/off) type; in other words, shut-off valve 21 may only either take an entirely open position or an entirely closed position. Specifically, shut-off valve 21 displays an efficaciously wide passage section to allow to sufficiently feed each pumping element 17 causing no drop of pressure.

The flow rate of high-pressure pump 6 is only controlled by using shut-off valve 21 which is controlled in choppered manner by electronic control unit 13 according to the fuel pressure in common rail 5. Specifically, electronic control unit 13 opens shut-off valve 21 during the initial part of the intake stroke of each pumping element 15 and continuously modulates the closing of the shut-off valve 21 itself to control the actual duration of the efficacious intake step of the intake stroke. It is important to underline that the two pumping elements 15 are actuated in step opposition with respect to each other and therefore the fuel sent to high-pressure pump 6 through intake pipe 9 is only taken in by one pumping element 15 at a time, which at that time is performing the intake stroke (at the same time, intake valve 19 of the other pumping element 15 is surely closed being the other pumping element 15 at compression step).

Figure 2:
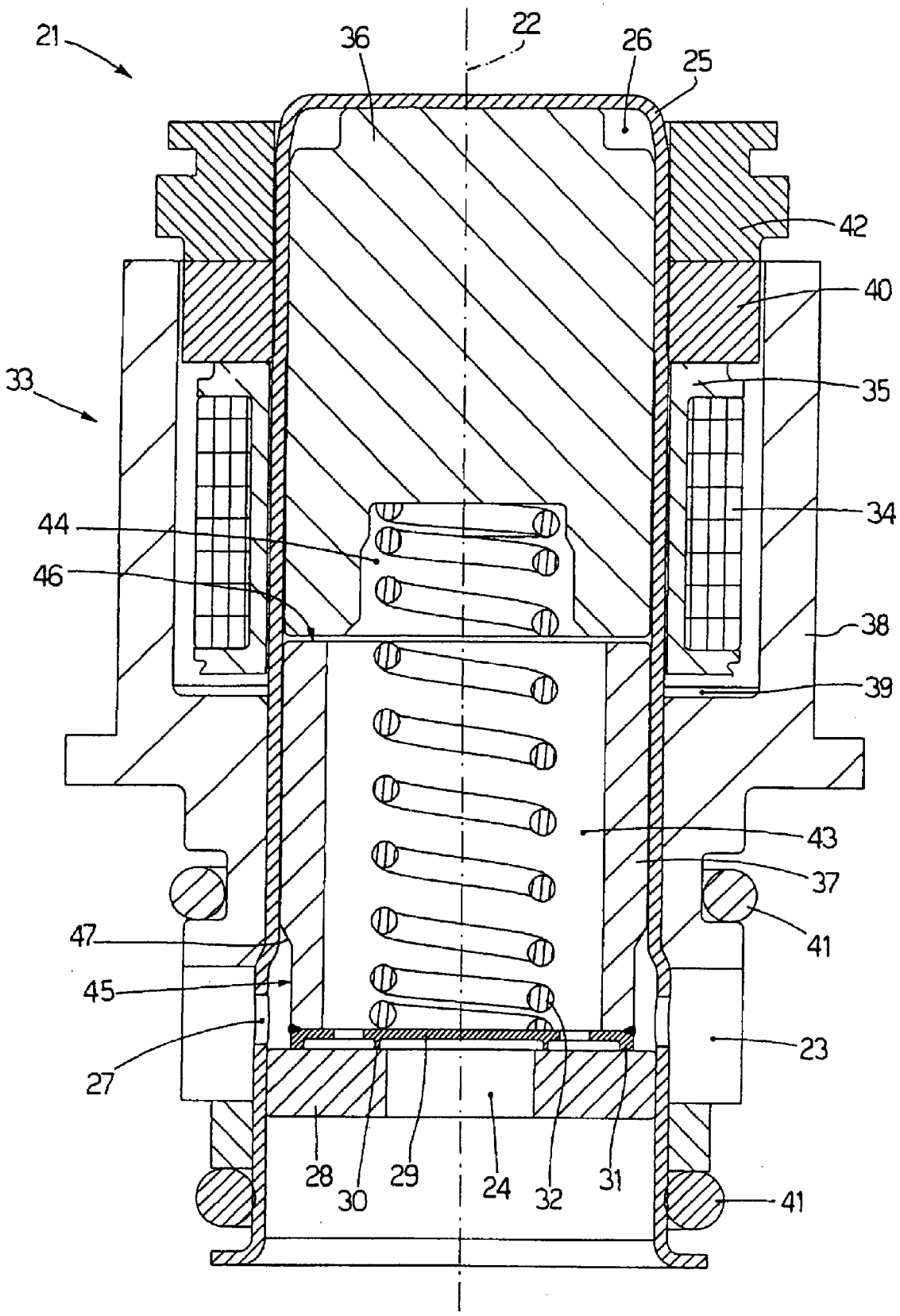
FIG. 2 is a schematic and side section view of the flow rate shut-off valve of FIG. 1.
Figure 3:
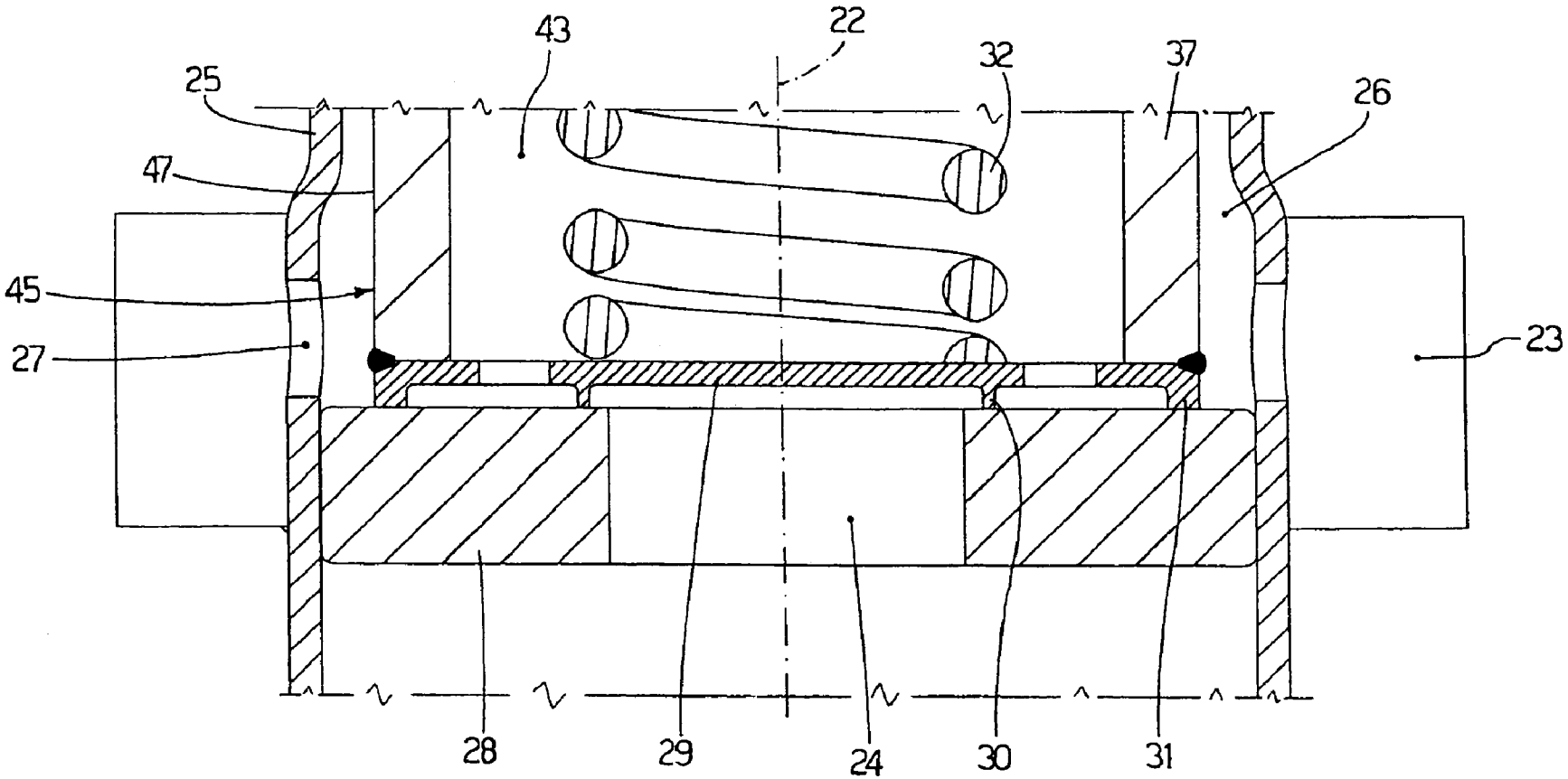
FIG. 3 is a schematic, side section and magnified view of the flow rate shut-off valve of FIG. 2.

As shown in FIG. 2, shut-off valve 21 essentially displays a cylindrical symmetry about a longitudinal axis 22, receives the fuel radially (i.e. perpendicularly to longitudinal axis 22) through an annular cylindrical chamber 23 and feeds the fuel axially (i.e. coaxially to longitudinal axis 22) from a lower outlet opening 24.

Shut-off valve 21 comprises a tubular cylindrical body 25, which is closed on top, formed by drawing of ferromagnetic steel, and displays a cylindrical seat 26 which in its lower portion performs the function of fuel pipe. At annular chamber 23, tubular body 25 comprises a number of radial through holes 27, which have the function to allow the intake of fuel within cylindrical seat 26.

Within cylindrical seat 26 and underneath radial holes 27 a lower plate 28 is arranged, which is laterally welded to tubular body 25 and displays a central through hole which defines the outlet opening 24. To the lower plate 28 a cylindrical shutter 29 is coupled, which is mobile between an open position, in which outlet opening 24 is in communication with radial holes 27, and a closed position, in which outlet opening 24 is isolated from radial holes 27.

From a lower surface of cylindrical shutter 29 arranged facing closing plate 28 protrudingly rise an inner ring 30 having a diameter slightly larger than outlet opening 24 and an outer ring 31 arranged at the outer edge of cylindrical shutter 29. Inner ring 30 defines a sealing element, which is adapted to isolate outlet opening 24 from radial holes 27 when shutter 29 is arranged in closed position resting against lower plate 28.

Shutter 29 is held in closed position resting against lower plate 28 by a spring 32 which is compressed between an upper surface of shutter 29 and an upper wall of tubular body 25. Furthermore, an electromagnetic actuator 33 is provided, which is driven by electronic control unit 13 to shift shutter 29 from the closed position to the open position against the bias of spring 32.

Electromagnetic actuator 33 comprises a coil 34, which is arranged externally around tubular body 25 and is enclosed in a plastic material toroidal case 35, a fixed magnetic pole 36, which is formed by ferromagnetic material and which is arranged within tubular body 25 at coil 34, and a mobile keeper 37, which has a cylindrical shape, is formed by ferromagnetic material, is mechanically connected to shutter 29, and is adapted to be magnetically attracted by magnetic pole 36 when coil 34 is energised (i.e. current passes through the coil). Furthermore, electromagnetic actuator 33 comprises a tubular magnetic casing 38, which is formed by ferromagnetic material, is arranged externally to tubular body 25 and comprises an annular seat 39 to accommodate coil 34, and a ring-shaped magnetic washer 40, which is formed by ferromagnetic material and is arranged over coil 34 to guide the opening of the magnetic flux around the coil 34 itself. Preferably, on the outer surface of magnetic casing 38 two seats are obtained to accommodate two elastic material sealing rings 41. Furthermore, over magnetic washer 40 and around tubular body 25 is arranged a lock ring 42, which holds magnetic washer 40 and coil 34 in position preventing a removal of magnetic washer 40 and of coil 34 from tubular body 25.

Keeper 37 has a tubular shape and is lowerly welded to shutter 29 at the outer edge of shutter 29 itself. Preferably, spring 32 is arranged through a central through opening 43 of keeper 37 and at its upper end is accommodated in an accommodating cavity 44 obtained in magnetic pole 36.

According to a preferred embodiment, an outer cylindrical surface 45 of keeper 37 and an upper annular surface 46 of keeper 37 are coated with a chromium coating 47 (indicatively having a 20-30 micron thickness); it is important to stress that chromium is a non-magnetic metal and has a low sliding friction coefficient (less than half with respect to steel). The function of chromium coating 47 on upper annular surface 46 of keeper 37 is to prevent the magnetic sticking of keeper 37 onto magnetic pole 36 while always maintaining a minimum gap between keeper 37 and magnetic pole 36. The function of chromium coating 47 on outer cylindrical surface 45 of keeper 37 is both to facilitate the sliding of keeper 37 with respect to tubular body 25, and to level the side gap (always maintaining a minimum gap between keeper 37 and annular body 25) so as to avoid magnetic side sticking and to balance the radial magnetic forces.

According to a preferred embodiment, shutter 29 displays a number of through holes, which are arranged between inner ring 30 and outer ring 31 and have the main function of avoiding fuel pumping phenomena during the shifts of shutter 29. Furthermore, the through holes allow a certain passage of fuel within central through opening 43 of keeper 37 and of accommodating cavity 44 obtained in magnetic pole 36 so as to allow an adequate washing of the entire keeper 37. In this regard, it is important to underline that the presence of outer ring 31 implies a minor localised loss of load during the fuel flow towards outlet opening 24 and such localised load loss favours a minor flow of fuel along the side surface of keeper 37 and through the through holes to improve washing of keeper 37.

According to a preferred embodiment, shutter 29 is made of elastic steel and has a reduced thickness so as to be centrally deformed in elastic manner; in this regard, it is important to underline that shutter 29 is welded to keeper 37 only at its outer edge and therefore may be deformed centrally in elastic manner. Preferably, shutter 29 has a thickness from 0.2 mm to 0.6 mm and specifically has a thickness of approximately 0.3 mm.

Such elastic deformability of shutter 29 allows to recover possible clearance or manufacturing tolerances without impairing the optimal sealing of the shutter 29 itself. Furthermore, when shutter 29 passes from the open position to the closed position, spring 32 pushes shutter 29 against lower plate 28 until shutter 29 itself is caused to impact against lower plate 28; in virtue of the central flexibility of shutter 29, the impact of shutter 29 against lower plate 28 is absorbed by outer ring 31 and is not absorbed by inner ring 30 which must have a high planarity to assure an optimal sealing. In other words, at the time of impact of shutter 29 against lower plate 28, shutter 29 is centrally deformed in elastic manner determining a slight lifting of inner ring 30 which therefore must not absorb the energy developed by the impact.

During the assembly of shut-off valve 21, one of the last operations is the welding of lower plate 28 to tubular body 25; indeed, such operation is performed during a calibration step because the exact axial position of lower plate 28 along tubular body 25 is determined experimentally so as to compensate for possible clearance or manufacturing tolerances and to therefore obtain from shut-off valve 21 performance either equal or very near to nominal performance.

Shut-off valve 21 described above has many advantages, because it is easy and cost-effective to implement and at the same time has both high, constant-in-time nominal performance (particularly a high response speed) and a high compliance to nominal performance. Accordingly, above-described shut-off valve 21 displays a very favourable performance/cost ratio. It is important to underline that the low manufacturing costs are related to the various possibilities of recovering or compensating manufacturing tolerances; accordingly, it is not necessary to carry out very high precision machining (expensive and subject to a high number of rejects) of the various components of shut-off valve 21. Furthermore, coil 34 is arranged outside tubular body 25 and is therefore isolated from the fuel (this solution is commercially known as "dry coil"); in this way, isolation of the coil need not be fluid-tight and need not withstand the corrosion generated by the fuel and may accordingly be much simpler and cost-effective with respect to an equivalent isolation intended to come into contact with the fuel.

The invention claimed is:

1. A shut-off valve (21) of the flow rate of a fuel pump (6) for an internal combustion engine (2); the shut-off valve (21) comprises:

a tubular cylindrical body (25), which is closed on top, displays a cylindrical seat (26), the lower portion of which performs the function of fuel pipe, and comprises a number of radial through holes (27) to allow the introduction of fuel within the cylindrical seat (26);

a lower plate (28), which is arranged within the tubular cylindrical body (25) underneath the radial holes (27) and displays a central through hole which defines an outlet opening (24) of the fuel; and a cylindrical shutter (29), which is coupled to the lower plate (28) and is mobile between an open position, in which the outlet opening (24) is in communication with the radial holes (27), and a closed position, in which the outlet opening (24) is isolated from the radial holes (27);

the shut-off valve (21) is characterized in that from a lower surface of the cylindrical shutter (29) arranged facing the closing plate (28) an inner ring (30) protrudingly rises, the diameter of which is slightly larger than that of the outlet opening (24) and defines a sealing element for isolating the outlet opening (24) of the radial holes (27) when the shutter (29) is arranged in the closed position resting against the lower plate (28).

2. A shut-off valve (21) according to claim 1, wherein from a lower surface of the cylindrical shutter (29) arranged facing the closing plate (28) an outer ring (31) protrudingly rises, which is arranged at the outer edge of the cylindrical shutter (29).

3. A shut-off valve (21) according to claim 2, wherein the shutter (29) displays a number of through holes, which are arranged between the inner ring (30) and the outer ring (31).

4. A shut-off valve (21) according to claim 1 and comprising a spring (32), which is compressed between an upper surface of the shutter (29) and an upper wall of the tubular body (25) to hold the shutter (29) in the closed position resting against the lower plate (28).

5. A shut-off valve (21) according to claim 4 and including an electromagnetic actuator (33) for shifting the shutter (29) from the closed position to the open position against the bias of the spring (32).

6. A shut-off valve (21) according to claim 5, wherein the electromagnetic actuator (33) comprises:

a coil (34);

a fixed magnetic pole (36), which is arranged within the tubular body (25); and a mobile keeper (37), which has a cylindrical shape, is mechanically connected to the shutter (29) and is adapted to be magnetically attracted by magnetic pole (36) when the coil (34) is energised.

7. A shut-off valve (21) according to claim 6, in which the coil (34) is arranged externally around the tubular body (25) and is enclosed in a plastic material toroidal case (35); the fixed magnetic pole (36) is arranged within the tubular body (25) at the coil (34).

8. A shut-off valve (21) according to claim 7, wherein the electromagnetic actuator (33) comprises:

a tubular magnetic casing (38), which is arranged externally to the tubular body (25) and comprises an annular seat (39) for accommodating within the coil (34); and a ring-shaped magnetic washer (40), which is formed by ferromagnetic material and is arranged over the coil (34) to guide the closing of the magnetic flux around the coil (34) itself.

9. A shut-off valve (21) according to claim 8 and comprising a lock ring (42), which is arranged over the magnetic washer (40) and around the tubular body (25) to hold the magnetic washer (40) and the coil (34) in position and to prevent a removal of the magnetic washer (40) and of the coil (34) from the tubular body (25).

10. A shut-off valve (21) according to claim 6, wherein the shutter (29) is welded to the keeper (37) at its outer edge.

11. A shut-off valve (21) according to claim 6, wherein the spring (32) is arranged through a central through opening (43) of the keeper (37) and at its upper end is accommodated in an accommodating cavity (44) obtained in the magnetic pole (36).

12. A shut-off valve (21) according to claim 6, wherein a top annular surface (46) of the keeper (37) is coated with a chromium coating (47).

13. A shut-off valve (21) according to claim 6, wherein an outer cylindrical surface (45) of the keeper (37) is coated with a chromium coating (47).

14. A shut-off valve (21) according to claim 12, wherein the chromium coating (47) has a thickness of 20-30 microns.

15. A shut-off valve (21) according to claim 1, wherein the shutter (29) is formed by elastic steel and has a reduced thickness so as to be centrally deformable in elastic manner.

16. A shut-off valve (21) according to claim 15, wherein the shutter (29) has a thickness from 0.2 mm to 0.6 mm.

17. A shut-off valve (21) according to claim 15, wherein the shutter (29) has a thickness of approximately 0.3 mm.

18. A shut-off valve (21) according to claim 1, wherein the lower plate (28) is laterally welded to the tubular body (25).

19. A method of assembling a shut-off valve (21) according to claim 1; the method comprising the steps of:

welding the lower plate (28) to the tubular body (25) during a calibration step; and determining experimentally the exact axial position of the lower plate (28) along the tubular body (25) so as to compensate for possible clearance or manufacturing tolerances and to therefore obtain from the shut-off valve (21) performance equal to the nominal performance.

20. A fuel injection system (1) for an internal combustion engine (2) provided with four cylinders (3); the injection system (1) comprises:

a plurality of injectors (4), each of which is coupled to a cylinder (3) for injecting high-pressure fuel within the top of the cylinder (3) itself;

a common rail (5), which feeds the fuel to the injectors (4);

a high-pressure pump (6) which feeds the fuel to the common rail (5) by means of a delivery pipe (7);

a low-pressure pump (8) which feeds the fuel to the high-pressure pump (6) by means of an intake pipe (9) of the high-pressure pump (6) itself;

a shut-off valve (21) of the open/closed type, which is obtained according to claim 1 and is arranged along the intake pipe (9) between the low-pressure pump (8) and the high-pressure pump (6); and a control unit (13) for controlling in a choppered manner the shut-off valve (21) and accordingly regulating the actual flow rate of the high-pressure pump (6).

* * * * *